United States Patent [19]

Parvin

[11] Patent Number: 5,002,402

[45] Date of Patent: Mar. 26, 1991

[54] UNHANDED SLIDE LATCH DEVICE

[75] Inventor: Jackie D. Parvin, Pomona, Calif.

[73] Assignee: Standard Precision, Inc., Santa Fe Springs, Calif.

[21] Appl. No.: 429,775

[22] Filed: Oct. 30, 1989

[51] Int. Cl.[5] ..... A47B 88/00

[52] U.S. Cl. ..... 384/21; 312/348; 384/23

[58] Field of Search ..... 384/18, 19, 20, 21, 384/23; 312/348, 338

[56] References Cited

U.S. PATENT DOCUMENTS

| | | | |
|---|---|---|---|
| 2,277,705 | 3/1942 | Kennedy et al. | 384/21 |
| 3,142,517 | 7/1964 | Ward | 312/348 X |
| 3,205,025 | 9/1965 | Jordon | 384/18 |
| 3,746,418 | 7/1973 | Barber, Jr. | 312/348 |
| 3,771,849 | 11/1973 | Barber | 312/350 |
| 3,778,120 | 12/1973 | Hagan et al. | 384/18 |
| 3,912,341 | 10/1975 | Stein | 312/331 X |
| 3,923,347 | 12/1975 | Dean | 312/348 X |
| 3,937,531 | 2/1976 | Hagen et al. | 312/348 X |
| 3,995,927 | 12/1976 | Stein | 312/333 |
| 4,065,196 | 12/1977 | Stein | 312/333 |
| 4,201,423 | 5/1980 | Hagan et al. | 384/49 |
| 4,274,689 | 6/1981 | Vander Ley et al. | 312/348 X |
| 4,304,449 | 12/1981 | Litchfield et al. | 312/341 R |
| 4,324,439 | 4/1982 | Hagen et al. | 384/18 |
| 4,423,914 | 1/1984 | Vander Ley | 312/348 X |
| 4,441,772 | 4/1984 | Fielding et al. | 312/330 R |
| 4,469,381 | 9/1984 | McGuffie . | |
| 4,469,384 | 9/1984 | Fler et al. | 312/348 X |
| 4,537,450 | 8/1985 | Baxter . | |
| 4,549,773 | 10/1985 | Papp et al. | 384/18 |
| 4,560,212 | 12/1985 | Papp et al. | 384/18 |
| 4,600,255 | 7/1986 | Dubarko | 312/333 |
| 4,679,950 | 7/1987 | Delmege et al. | 384/18 |
| 4,696,582 | 9/1987 | Kasten | 384/18 |
| 4,749,242 | 6/1988 | Rechberg | 312/333 |
| 4,872,734 | 10/1989 | Rechberg | 312/333 |

OTHER PUBLICATIONS

Accuride Model C3800 Brochure, Oct. 1985.
Accuride Model 3800, 3837 Brochure, Aug. 1988.
Grant Corp. Product No. 5633, July 1987.

*Primary Examiner*—Joseph J. Hail, III
*Assistant Examiner*—William G. Battista, Jr.
*Attorney, Agent, or Firm*—James E. Hawes

[57] ABSTRACT

The preferred latch device consists of two elements, attached to interfitting longitudinally movable slide members in a relationship to pass adjacent to one another as the slide members move longitudinally. The elements each carry stops which are positioned to engage one another as the elements come into an adjacent relationship to limit further travel of the slide members. One of the elements is pivotally attached to its slide member, and movable both clockwise and counter clockwise, to displace the stops sufficiently to clear its stops on the other element and permit the slide members to be disconnected. Preferably the rear faces of the stops on one element are sloped in parallel planes to engage the stops on the other element as the slide members are being reconnected, and to cam the pivotal element sufficiently to cause the stops to clear one connection, permitting the slide members to be easily reconnected.

14 Claims, 2 Drawing Sheets

UNHANDED SLIDE LATCH DEVICE

BACKGROUND OF THE INVENTION

The present invention relates to an unhanded slide latch device.

Slide mechanisms are used in a wide variety of different applications. One common application is to mount a drawer to a supporting member, such as a desk. The interleaved, extensible slide members enable the drawer to be opened and closed with ease. The slide members customarily include latches or stops to prevent the drawer from being opened beyond a given extension.

At times it is desirable to be able to remove the drawer from the supporting structure. For this purpose, a special, releasable slide latch device must be provided. Many such releasable latch devices have been designed and are in use today. For example, one design employs a resilient metallic blade on one slide member that incorporates an opening which receives a stud on an adjacent slide member to limit the travel of the two slide members relative to one another. By depressing the blade, its surface may be caused to clear the stud and the slides moved relative to one another and disconnected. Another releasable latch device employs two cooperating plastic members which have aligned walls such that when one slide member is moved relative to the other sufficiently, the walls engage and prevent further travel of the slide members. A projecting finger on one of the plastic members permits its wall to be moved out of alignment with the wall on the other plastic member, and the slides to be disconnected.

In use, such latch devices should be easily actuated even by this occasional or inexperienced operator. Many applications also require the latch device to be relatively silent; the clank of two metallic surfaces engaging one another is objectionable. Also, many applications require such latch devices to be quite rugged. For example, one common test for drawer slides requires slide mechanisms to withstand both 15,000 two inch travel impacts and five full travel impacts in response to a ten pound pull while the drawer carries a load of 75 pounds.

Since the preferred latch device should be designed to be used in standard constructions of slides, it must also be received between two closely fitting slide members, yet clear the screws, rivets, and other attachment means that connect the slide members to one another, and to the supported members. Finally, the design of the latch device should be such that it can be employed in automated manufacturing operations; this means that, for example, any element which is reversible should work in either orientation.

These and further objects of the invention will appear from in the following detailed description of a preferred embodiment of the unhanded slide latch device.

SUMMARY OF THE INVENTION

The latch device in its preferred form, is designed to limit the longitudinal travel of the two interlocking members, yet to permit these slide members to be disconnected when desired. In its preferred form, the latch device includes a first element that is pivotally attached to one of the slide members, and a second element is attached to the second member in a position such that it lies adjacent to the first element during at least a portion of the longitudinal path of travel of the slide members relative to one another. Each of the two elements includes at least one stop member, located to engage one another as the slide members are moved to bring the elements into an adjacent relationship. Means are included to hold the first element in a normal position, relative to its slide, but to permit to be moved in either of at least two directions, such as clockwise and counter-clockwise, from said normal position sufficiently to displace its stop member from the path of travel of the opposed stop member and to permit the slide member thereby be disconnected.

Preferably the latch device includes cam means to move the first element sufficiently to cause the stops to clear one another when the slide members are being reconnected and interlocked with one another. Also, preferably both elements of the latch device are symmetrical about the longitudinal axis of their slide members. The symmetry is with respect to placement of the interlocking members, not the direction of orientation of the cam means.

BRIEF DESCRIPTION OF THE DRAWINGS

The invention will be further described in connection with the accompanying drawings, in which.

DETAILED DESCRIPTION

Figure 1:
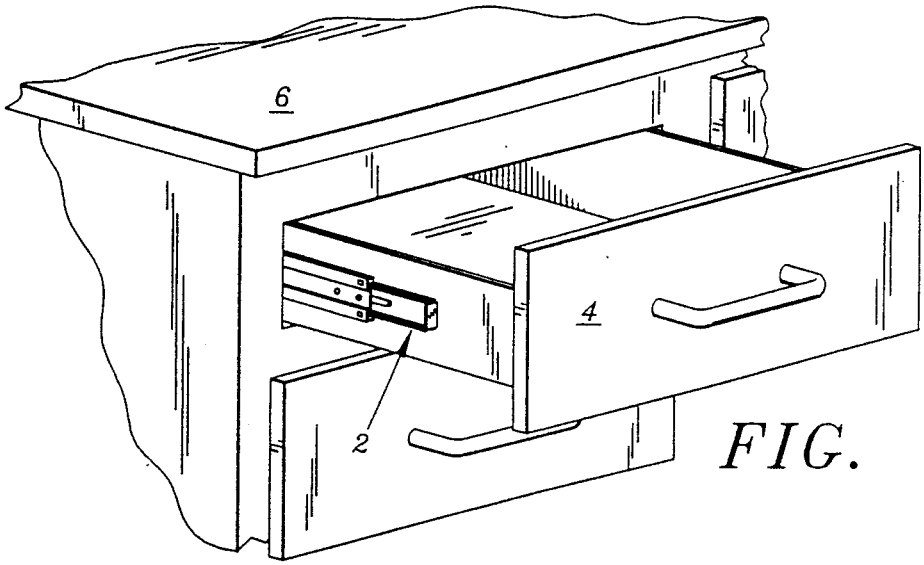
FIG. 1 is a perspective view showing a drawer received in a desk, only a portion of which is shown.

The unhanded drawer slide latch device of the present invention can be used in a wide variety of slide assemblies employed in any of various applications. For example, it can be incorporated in the slide assembly used to attach a drawer to a supporting structure, such as a cabinet or desk. Such an arrangement is shown in FIG. 1 in which slide assembly 2 attaches drawer 4 to the supporting desk structure 6.

Figure 2:
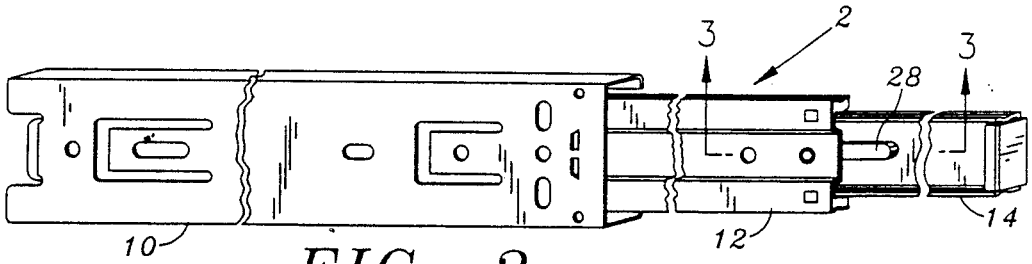
FIG. 2 is a plan view of the slide assembly shown in FIG. 1 incorporating the unhanded latch device of the present invention.
Figure 3:
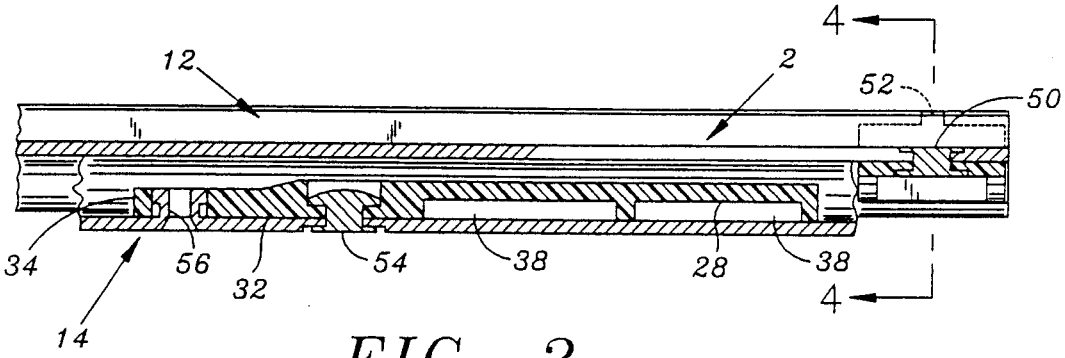
FIG. 3 is a cross sectional view taken on lines 3—3 of FIG. 2.

The slide assembly itself is shown in plan view in FIG. 2, and in partial cross-section in FIG. 3. The general construction of such slide assemblies is well known; it is described for example in various United States patents such as U.S. Pats. No. 3,205,025, 3,778,120 or 3,771,849.

In general, slide assemblies consist of an outer, base or cabinet member 10 that receives an intermediate member 12 which in turn supports an inner or drawer member 14. The members of the slide assembly preferably ride over one another on ball bearing assemblies, not shown. The inner member is attached by screws or other suitable devices to the drawer, while the cabinet member is attached to the supporting desk structure. When the drawer is moved relative to the desk, both the inner and intermediate members move relative to one another and to the cabinet member, rolling along the sets of ball bearings carried between them.

Each member of the slide assembly incorporates a stop or latch that is aligned with a corresponding stop or latch on the adjacent member to limit travel of the outer, intermediate and inner members relative to one another, thereby preventing the drawer from being unintentionally removed from the desk. In certain applications, it is desirable to be able to remove the drawer from the supporting structure. This in turn requires use in the slide assembly of cooperating latches that can be selectively disengaged. Such disengagement should be easily effected, even by an inexperienced user. For that reason, the latch device incorporated in the slide assembly should be capable of being disengaged by movement in either direction; it should not be necessary to move the left slide latch device in one direction and the right slide latch device in the opposite direction, for such a requirement has been found to so challenge the inexperienced or occasional operator that they will usually not be successful in effecting disconnection of one slide member from the other.

The preferred embodiment of the latch device of the present invention consists of two elements. The pivoting element 16 is i perspective view in FIGS. 5. The fixed element 18 is shown in perspective view in FIG. 6.

The pivoting element 16 of the latch device, in its preferred embodiment, consists of a planar base portion 20 that includes, at one end, an opening 22 surrounded by an upstanding cylindrical wall 24. Extending along the longitudinal axis of base 20 from the cylindrical wall 24 is an upstanding ridge or rib 26 that projects beyond the base to form a lever or finger 28. Upstanding from the lateral edges of base 20, and extending in a direction generally parallel to rib 26, are stops or walls 30. Two of these walls are provided, one on each side of the rib, the walls being equally spaced from the rib. The function and features of these walls will be described shortly.

The pivoting element 16 also includes a leg 32 extending from base 20 and aligned with rib 26 along the longitudinal axis of the element. This leg, at its inner end, merges into cylindrical wall 24 about opening 22 and, at its outer end, terminates in a ring 34 that incorporates and defines an opening 36 which is slightly elongated in the direction of the longitudinal axis of the element, again for a reason which will be described shortly. The thickness of ring 34 preferably is slightly greater (e.g. 0.015") than the thickness of base 20 of the element for sufficient resiliency to hold the pivoting element in the illustrated orientation. Rib 26 and finger 28 may each include a recess 38 (see FIG. 3) to minimize or eliminate any differential shrinkage and sinkage during cooling, and warpage in base 20.

Figure 6:
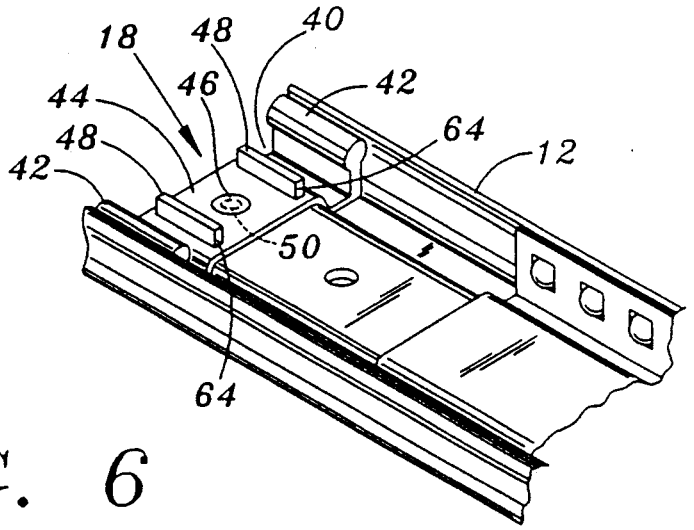
FIG. 6 is a perspective view of the fixed latch element of the present invention.

The fixed element 18 of the latch device, attached to the intermediate member 12 of the slide assembly, is shown in perspective view in FIG. 6. It consists of a generally rectangular body that includes, at each outer end, a cylindrical lobe guide 42. The center portion of the body is raised to form a plateau in area 44. A central opening 46 is provided in this plateau. On either side of the opening, extending in a direction parallel to lobe guides 42, are stops or walls 48. As shown most clearly in FIG. 4, a rivet 50 passes through opening 46 in fixed element 18 and through an opening in the intermediate slide member 12 to attach the element to the slide. The head of this rivet is received in a countersunk recess in opening 46 such that the upper surface of the rivet does not extend beyond the upper surface of plateau 44 between walls 48. The opposed rails of the intermediate slide member pass along the innerfaces of lobe guides 42, as shown in FIG. 4, the lobe guides thereby assisting in positioning and guiding the insertion of the inner slide member relative to the fixed element.

Figure 4:
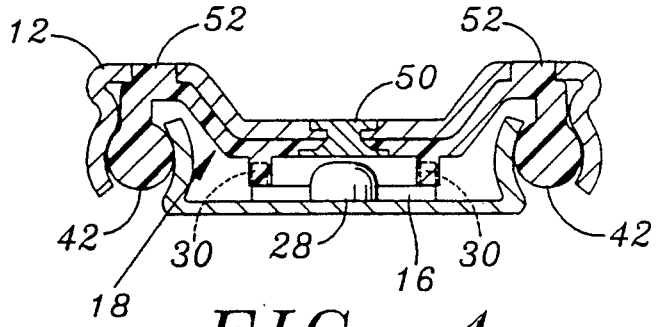
FIG. 4 is a cross-sectional view taken on lines 4—4 of FIG. 3.

Preferably the fixed element 18 of the latch device also includes a pair of square bosses 52, each generally underlying the trough in element 40 between lobe guide 42 and wall 48, these square bosses being snugly received in openings provided in the intermediate slide member 12 as shown in FIG. 4. In this fashion, the fixed element 18 is attached to the slide by rivet 50; torquing and longitudinal movement of the fixed member relative to the intermediate slide member is resisted by not only the rivet but also by the interlocking of the element with the slide as a result of the square bosses being received in corresponding holes in the intermediate member 12.

As shown in FIG. 3, the pivoting element 16 is attached to the inner slide member by a rivet 54 received in an opening in the inner drawer member. The inner drawer member also includes a short upstanding cylindrical extrusion 56 that is spaced along the longitudinal axis of the inner slide member such that it that it receives ring 34 when the pivoting element 16 is attached to the inner member as shown. The outer diameter of extrusion 56 is slightly smaller than the inner diameter of the opening in ring 34.

Preferably both elements of the latch device are injection molded from a resilient material such as acetal; the pivoting element 16 is Celenese TX-90 and the fixed element 18 is Celenese M-90. Thus, by pressing against lever 28, element 16 may be pivoted about rivet 54 received in opening 22, which in turn flexes leg 32 and causes ring 34 to rotate about the cylindrical extrusion 56 of the intermediate slide member. Since this movement will also pull the ring 34 toward rivet 54, the opening 32 in the ring is elongated slightly to accommodate and permit this longitudinal motion.

Figure 5:
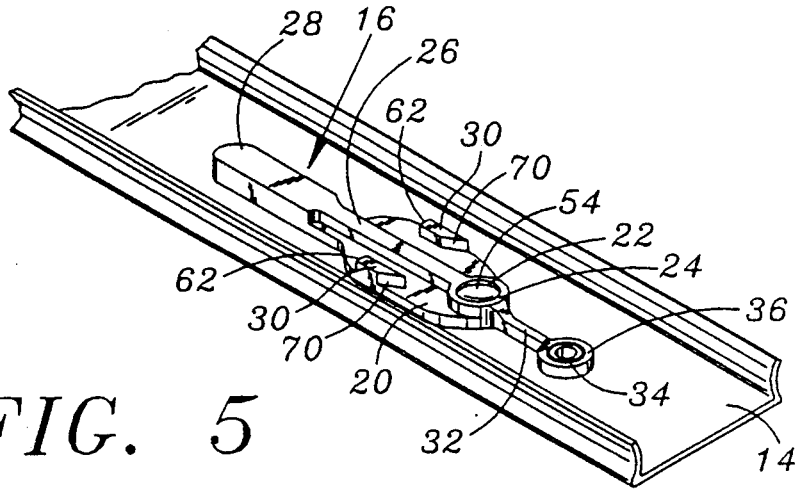
FIG. 5 is a perspective view of the pivoting latch element of the present invention.

When attached to the slide members as shown in FIGS. 3 and 4, the elements of the latch device will engage one another (as best shown in FIG. 4) when the inner slide member is pulled to the limit of its travel relative to the intermediate slide member. Specifically, (and as best shown in FIGS. 5 and 6) the squared face 62 of each wall 30 engages the corresponding squared end 64 of wall 48. The sizing and relationship of the elements of the latch device, as mounted on their respective slide members, is such that solid abutment of these opposed faces is achieved for both walls 30 against walls 48. This results in a definite stop, preventing further movement of the inner slide member relative to the intermediate slide member. Because the abutting elements preferably are made of a plastic material, instead of a metallic material, the click of a metal contact is avoided, which would be objectionable in many slide applications.

It will be noted that both the fixed element and the pivoting element of the latch device are symmetrical about the longitudinal axis of their respective slide members, when mounted as shown in FIGS. 5 and 6. Also, each is attached to its respective slide member along the slide's longitudinal axis. Thus, when the slide members are pulled to the limit of their normal travel, as defined by the abuding relationship of these two latch elements, each face 62 will bear with equal force on the corresponding face 64 of the opposed element, and no net torque will be applied to either the fixed or pivoting element of the latch device.

To disconnect the inner slide member from the intermediate slide member, it is only necessary for the user to press on lever 28. Moving it in either direction, clockwise or counterclockwise about rivet 54, to the point were wall 30 now can clear the normally abutting face of wall 48, will permit the slide members to be separated completely.

To reattach the slide members, it is only necessary to insert the inner slide member into the intermediate slide member, then push the two to a closed position. As they move toward a closed position, inclined faces 70 on walls 30 will engage faces 64 of walls 48. Because both inclined faces 70 slope in the same direction (in parallel planes) relative to walls 48, these faces will cooperate, when they engage the ends of walls 48, to cam the pivoting element 16 about rivet 54 and permit the slide members to continue their travel and be completely nested, one in the other.

Because of the design and construction of the latch device, it may be incorporated in standard slide assemblies without requiring any change in the fitting or slide members of the assembly. The elements of the latch device will clear screw heads used to attach the inner and outer members of the slide assembly to adjacent structures, such as to a desk drawer and a desk frame.

Because both element 30 and element 48 of the latch device are symmetrical about their longitudinal center, the latch device is readily adaptable to automated assembly operations. It has been found, in the preferred construction, the latch device of the present invention is capable of meeting and exceeding the five full travel impacts and 15,000 two inch travel impacts, 75 pound drawer outstop test previously mentioned. This latch device is also "unhanded;" the slide assembly on both sides of the drawer, for example, may be disconnected by pressing lever 28 either up or down. Thus, even inexperienced operators can easily disconnect slides incorporating the latch device of the present invention. Moreover, the drawer member 14 of the left hand slide can be interchanged with drawer member 14 of the right hand slide with no change in function.

Variations in the design and construction of the preferred embodiment of the present invention will undoubtedly occur to those skilled in this art. For example, others may prefer to eliminate ring 34 and to position leg 32 between members punched up from the center portion of the inner slide member, or in an opening in one such member. Thus, the scope of the invention is as set forth in the following claims, interpreted consistent with the principles applicable thereto.

We claim:

1. A latch device for a slide assembly including two interlocking slide members movable longitudinally relative to one another, the latch device comprising:

A first element, means for attaching the first element to one of the slide members; means for holding the first element in a normal position, relative to the slide, but permitting it to be moved in either of at least two directions from said normal position;

A second element, means for attaching the second element to the second slide member such that it lies adjacent to the first element during at least a portion of the longitudinal path of travel of the slide members relative to one another;

A stop member on the first element;

A stop member on the second element aligned to engage the stop member of the first element when the first element is in its normal position, but to clear the stop member on the first element when the first element is moved in either of at least two directions from said normal position, whereby the first and second element may cooperate to limit longitudinal travel of the slide members but by moving the first element the slide members may be moved relative to one another beyond engagement of the stop members.

2. A latch device as set forth in claim 1 including cam means to move the first element sufficiently to cause said stop members to clear one another when the slide members are being reconnected with one another.

3. A latch device as set forth in claim 1 in which both of said elements are placed symmetrically about the longitudinal axis of the slide members.

4. A latch device as set forth in claim 1 in which at least one of said elements is made from a plastic material.

5. A latch device as set forth in claim 1 in which at least one of said elements includes projecting studs to be snugly received in openings of its supporting slide member, the studs cooperating with the portion of the member defining said openings to resist longitudinal movement of said element relative to said member.

6. A latch device as set forth in claim 1 in which said first element includes a lever projecting beyond the end of said second slide member when the stops of said first and second elements are engaged, the lever being movable to move the first element in either of said two directions from the normal position to cause the stop member of the first element to clear the stop member of the second element.

7. A slide assembly comprising:

At least two channel slide members, the slide members being shaped to interlock with one another and to be movable longitudinally relative to one another, and a latch device comprising;

A first element, means attaching the first element to one of the slide members for pivotal movement in either a clockwise or counter-clockwise direction from a normal position relative to the first slide member;

a second element, means attaching the second element to the second slide member such that it lies adjacent to the first element during at least a portion of the longitudinal path travel of the slide members relative to one another;

At least one stop member on the first element:

At least one stop member on the second element aligned to engage the stop member of the first element when the first element is in its normal position, but to clear the stop member of the first element when the first element is moved in either a clockwise or counter-clockwise direction from said normal position;

whereby the first and second elements of the latch device cooperate to limit longitudinal travel of the slide members relative to one another, but by pivoting the first element the slide members may be moved relative to one another beyond engagement of the stop member.

8. A slide assembly as set forth in claim 7 including cam means to pivot the first element efficiently to cause said stops to clear one another when the slide members are being reconnected with one another.

9. A slide assembly as set forth in claim 7 in which both of said elements are placed symmetrically about the longitudinal axis of the slide members.

10. A slide assembly as set forth in claim 7, each element including a stop means on each side of the longitudinal axis of the elements, both said attachment means attaching the respective elements at the longitudinal axis of the slide members, the stop means being equally spaced from the longitudinal axis such that when the stop means engage to limit longitudinal movement of the slide members relative to one another no torque is applied to twist either element.

11. A slide assembly as set forth in claim 10, including cam means to rotate the first element sufficiently to cause said stops to clear one another when the slide members are being reconnected with one anther.

12. A slide assembly as set forth in claim 11 in which said cam means comprise faces on said stops to, when the slides are being reconnected with one another, rotate the first element in a given direction and thereby turn the first element sufficiently to permit its stops to clear the stops on said second element.

13. A slide assembly as set forth in claim 12 in which said second element is attached adjacent to an end of said second slide member, said second element including projecting bosses, said second slide member including openings to receive the projecting bosses of said second element, said elements being formed of a plastic material.

14. A slide assembly as set forth in claim 11 in which said first element includes a lever projecting beyond the end of said second slide member when the stops of the first and second elements are engaged, the lever being movable to rotate the first element in a clockwise or counter clockwise direction sufficiently to cause its stops to clear the stops of the second element.

* * * * *